US010701475B2

(12) United States Patent
Chen et al.

(10) Patent No.: US 10,701,475 B2
(45) Date of Patent: Jun. 30, 2020

(54) SOUND ABSORBING ASSEMBLY FOR SPEAKER MODULE AND SPEAKER MODULE

(71) Applicant: Goertek Inc., Weifang City, Shandong (CN)

(72) Inventors: Aliang Chen, Weifang (CN); Guangfu Liu, Weifang (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 16/098,678

(22) PCT Filed: Dec. 29, 2016

(86) PCT No.: PCT/CN2016/113239
§ 371 (c)(1),
(2) Date: Nov. 2, 2018

(87) PCT Pub. No.: WO2017/197895
PCT Pub. Date: Nov. 23, 2017

(65) Prior Publication Data

US 2019/0141436 A1 May 9, 2019

(30) Foreign Application Priority Data

May 20, 2016 (CN) ..... 2016 1 0344658

(51) Int. Cl.
*H04R 1/28* (2006.01)
*H04R 1/02* (2006.01)

(52) U.S. Cl.
CPC ..... *H04R 1/2803* (2013.01); *H04R 1/288* (2013.01); *H04R 1/025* (2013.01); *H04R 2201/029* (2013.01)

(58) Field of Classification Search
CPC .... H04R 1/2803; H04R 1/2876; H04R 1/288; H04R 1/28; H04R 1/025; H04R 9/06; H04R 2201/029; H04R 2499/11
See application file for complete search history.

(56) References Cited

U.S. PATENT DOCUMENTS 5,866,857 A 2/1999 Tseng
2013/0341118 A1* 12/2013 Papakyriacou ..... H04R 1/2803 181/199

(Continued)

FOREIGN PATENT DOCUMENTS

CN 2288564 Y 8/1998
CN 204131714 U 1/2015

(Continued)

OTHER PUBLICATIONS

Machine-generated translation, "CN102523550", Nov. 26, 2019, EPO, pp. 1-9. (Year: 2019).*

*Primary Examiner* — Davetta W Goins
*Assistant Examiner* — Daniel R Sellers
(74) *Attorney, Agent, or Firm* — Fox Rothschild LLP; Carol E. Thorstad-Forsyth

(57) ABSTRACT

A sound absorbing assembly for a loudspeaker module and a loudspeaker module are disclosed. The sound absorbing assembly comprises a holding shell, the holding shell is provided with a receiving trough, the receiving trough is filled with a sound absorbing material, the holding shell is fixed within a rear vocal cavity of the loudspeaker module by injection molding, a bottom of the receiving trough is provided with sound penetration holes, and an interior of the receiving trough communicates with the rear vocal cavity via the sound penetration holes. The sound absorbing assembly is provided with a receiving trough on the holding shell, and the sound penetration holes of the receiving trough form sound transmission channels, to enable the sound absorbing (Continued)

material placed within the receiving trough to perform the sound absorbing function, to improve the acoustic quality of the loudspeaker.

9 Claims, 3 Drawing Sheets

(56) References Cited

U.S. PATENT DOCUMENTS

| | | | | |
|---|---|---|---|---|
| 2016/0309254 | A1* | 10/2016 | Lembacher | H04R 1/28 |
| 2016/0345090 | A1* | 11/2016 | Wilk | B01D 53/04 |
| 2017/0041703 | A1* | 2/2017 | Herold | H04R 1/288 |
| 2017/0064438 | A1* | 3/2017 | Wilk | H04R 1/2811 |
| 2017/0111719 | A1* | 4/2017 | Fang | H04R 1/026 |
| 2018/0132035 | A1 | 5/2018 | Cao | |

FOREIGN PATENT DOCUMENTS

| | | | | | |
|---|---|---|---|---|---|
| CN | 102523550 | B | * | 2/2015 | H04R 31/00 |
| CN | 104811831 | A | | 7/2015 | |
| CN | 204929226 | U | | 12/2015 | |
| CN | 105307098 | A | | 2/2016 | |
| CN | 205029855 | U | | 2/2016 | |
| CN | 205179352 | U | | 4/2016 | |
| CN | 205232448 | U | | 5/2016 | |
| CN | 105872915 | A | | 8/2016 | |
| CN | 205793264 | U | | 12/2016 | |
| JP | 2000278780 | A | | 10/2000 | |

* cited by examiner

SOUND ABSORBING ASSEMBLY FOR SPEAKER MODULE AND SPEAKER MODULE

CROSS REFERENCE TO RELATED APPLICATIONS

This application is a U.S. National Stage entry under 35 U.S.C. § 371 based on International Application No. PCT/CN2016/113239, filed on Dec. 29, 2016, which was published under PCT Article 21(2) and which claims priority to Chinese Patent Application No. 201610344658.3, filed on May 20, 2016. The disclosure of the priority applications are hereby incorporated herein in their entirety by reference.

TECHNICAL FIELD

The present disclosure relates to the technical field of loudspeaker modules, and particularly relates to a sound absorbing assembly for a loudspeaker module and a loudspeaker module.

BACKGROUND

In recent years, the market imposes increasingly high requirements on the performance of loudspeaker modules, and the application of sound absorbing particles is increasingly extensive. In the prior art, when sound absorbing particles are applied within a loudspeaker module, usually a small cavity is designed in the rear vocal cavity within the housing of the loudspeaker. The small cavity is filled with the sound absorbing particles, a net cloth is injection molded at a sound penetration hole of the small cavity by integral molding technique to form a sealing device, the small cavity communicates with the vocal cavity via the net cloth, and the sound absorbing particles perform the sound absorption function.

In such a design, in order to ensure that the net cloth can be firmly injection molded on a small cavity, the wall thickness of the small cavity must be designed to be thick enough, for supporting the net cloth. However, that causes the vocal cavity space to reduce, which degrades the sound quality. Furthermore, by using that approach, the injection molding has low yield, and has a high requirement on the injection molding machine, which increases the production cost.

SUMMARY

In view of the problems of the prior art that the sound absorbing particles filling structure results in a small vocal cavity space and that injection molding has low yield, the present disclosure proposes a sound absorbing assembly for a loudspeaker module and a loudspeaker module, to overcome the above problems or at least partially solve the above problems.

According to an aspect of the present disclosure, there is provided a sound absorbing assembly for a loudspeaker module, wherein the sound absorbing assembly comprises a holding shell, the holding shell is provided with a receiving trough, the receiving trough is filled with a sound absorbing material, the holding shell is fixed within a rear vocal cavity of the loudspeaker module by injection molding, a bottom of the receiving trough is provided with a sound penetration hole, and an interior of the receiving trough communicates with the rear vocal cavity via the sound penetration hole.

In some embodiments, the holding shell is a metal stamping part, or is an injection molded part.

In some embodiments, a trough depth of the receiving trough is 1.5 mm.

In some embodiments, a material of the metal stamping part is stainless steel or copper alloy, and a plate thickness of the metal stamping part is 0.15 mm.

In some embodiments, two opposite edges of the holding shell are respectively provided with a fixing lug, and when the holding shell is being fixed by injection molding, the fixing lugs are injection molded within a housing of a vocal cavity of the loudspeaker module.

In some embodiments, a trough wall of the holding shell is also provided with sound penetration holes.

In some embodiments, the sound penetration hole is of a circle shape, with a diameter of 0.1 mm, and a plurality of the sound penetration holes are evenly distributed.

In some embodiments, the sound absorbing material is non-foaming porous particles.

According to another aspect of the present disclosure, there is provided a loudspeaker module, wherein the sound absorbing assembly according to any one of the above items is installed within a rear vocal cavity of the loudspeaker module.

In some embodiments, a gap is between a bottom of the holding shell and a bottom of the rear vocal cavity, and a width of the gap is 0.8 mm.

The advantages of the present disclosure are:

The sound absorbing assembly of the present disclosure is provided with a receiving trough on the holding shell, and the sound penetration holes of the receiving trough form sound transmission channels, to enable the sound absorbing material placed within the receiving trough to perform the sound absorbing function, to improve the acoustic quality of the loudspeaker. The holding shell has a thin wall thickness and a high strength, which can save the space of the vocal cavity, and facilitates improving the acoustic quality of the product. Furthermore, the holding shell is integrally fixed within a rear vocal cavity of the loudspeaker module by injection molding, and compared with injection molding net cloth, the injection molding of the holding shell has a high yield, and has low requirements on the injection molding process, which can save the cost and facilitates mass production.

BRIEF DESCRIPTION OF DRAWINGS

The present disclosure will hereinafter be described in conjunction with the following drawing figures, wherein like numerals denote like elements, and.

DETAILED DESCRIPTION

In order to make the objects, the technical solutions and the advantages of the present disclosure clearer, the embodiments of the present disclosure will be described below in further detail in conjunction with the drawings.

Figure 1:
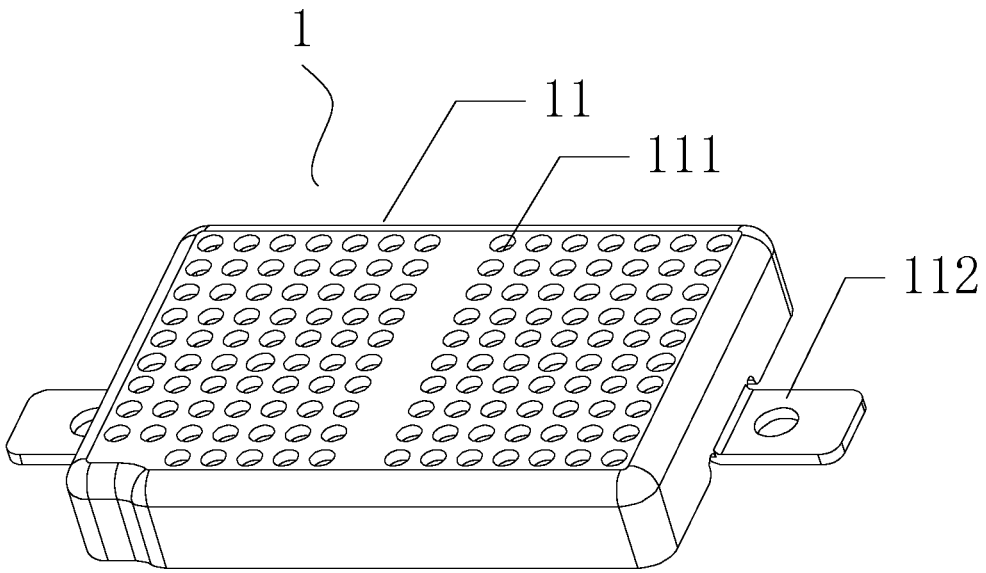
FIG. 1 is a perspective view of a sound absorbing assembly of the present disclosure.
Figure 2:
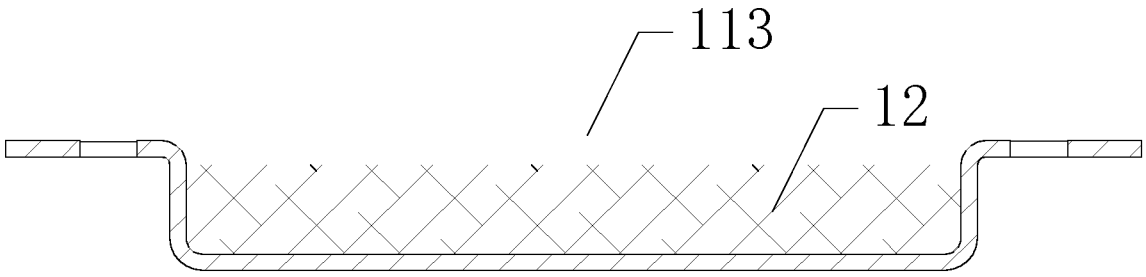
FIG. 2 is a sectional view of the sound absorbing assembly of the present disclosure.

FIG. 1 is a perspective view of a sound absorbing assembly of the present disclosure. FIG. 2 is a sectional view of the sound absorbing assembly of the present disclosure.

As shown in FIGS. 1-2, a sound absorbing assembly 1 for a loudspeaker module comprises a holding shell 11, the holding shell 11 is provided with a receiving trough 113, the receiving trough 113 is filled with a sound absorbing material 12, the holding shell 11 is fixed within a rear vocal cavity of the loudspeaker module by injection molding, a bottom of the receiving trough 113 is provided with sound penetration holes 111, and an interior of the receiving trough 113 communicates with the rear vocal cavity via the sound penetration holes 111. The sound penetration holes 111 form channels for sound transmission, so that the sound absorbing material 12 within the receiving trough 113 can perform the sound absorption function, to improve the acoustic quality of the loudspeaker.

The sound absorbing material 12 placed within the receiving trough 113 is non-foaming porous particles, such as activated carbon, natural zeolite powder, active silica and molecular sieve.

The holding shell 11 is a metal stamping part, the material of the metal stamping part is stainless steel or copper alloy, and a plate thickness of the metal stamping part is 0.15 mm Using the metal material can ensure the strength of the holding shell 11 while using the thin-wall structure to save the space of the vocal cavity, to more firmly load the sound absorbing material 12. In addition, stamping is a mature process, has low manufacturing cost and high qualification rate. Before stamping, the stamping part may be provided with sound penetration holes 111 by etching.

The sound penetration hole 111 is of a circle shape, with a diameter of 0.1 mm, and a plurality of the sound penetration holes 111 are evenly distributed. More preferably, the trough wall of the holding shell 11 is also provided with the sound penetration holes 111, to increase sound channels, and enable the sound absorbing material 12 to exhibit a better sound absorbing effect.

The depth of the receiving trough 113 of the holding shell 11 is 1.5 mm, and certainly, may also be adjusted according to the size of the rear vocal cavity of the loudspeaker module.

Figure 3:
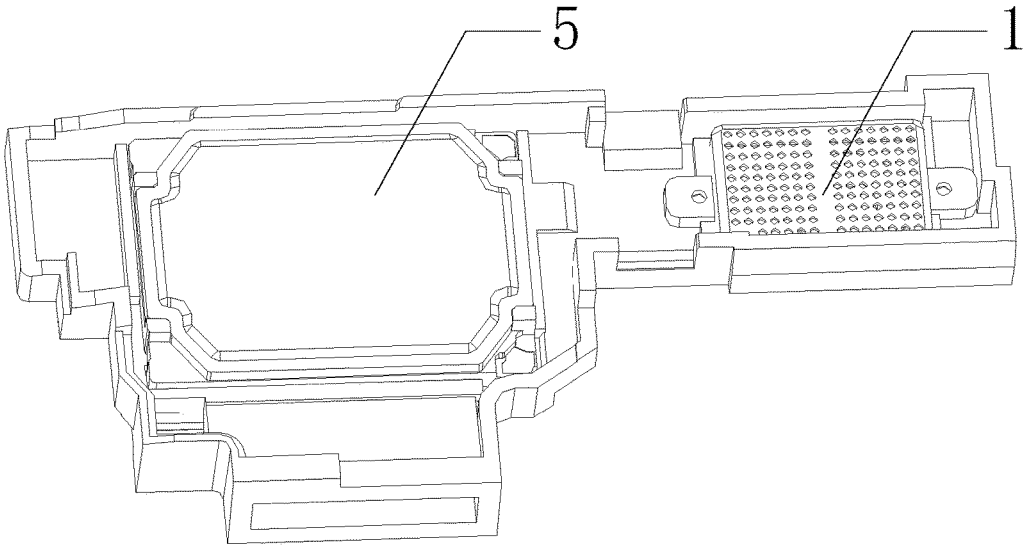
FIG. 3 is a schematic diagram of injection molding installation of the sound absorbing assembly within a loudspeaker module of the present disclosure.

Two opposite edges of the trough of the holding shell 11 are respectively provided with a fixing lug 112, and when the holding shell 11 is being fixed by injection molding, the fixing lugs 112 are injection molded within a housing of a vocal cavity of the loudspeaker module. FIG. 3 is a schematic diagram of injection molding installation of the sound absorbing assembly within the loudspeaker module of the present disclosure. As shown in FIG. 3, the sound absorbing assembly 1 is injection molded within a sealed upper housing 5 of the loudspeaker module. Preferably, each of the fixing lugs 112 may further be provided with a positioning hole, to ensure that the fixing of the holding shell 11 can be more accurate and firm.

Figure 4:
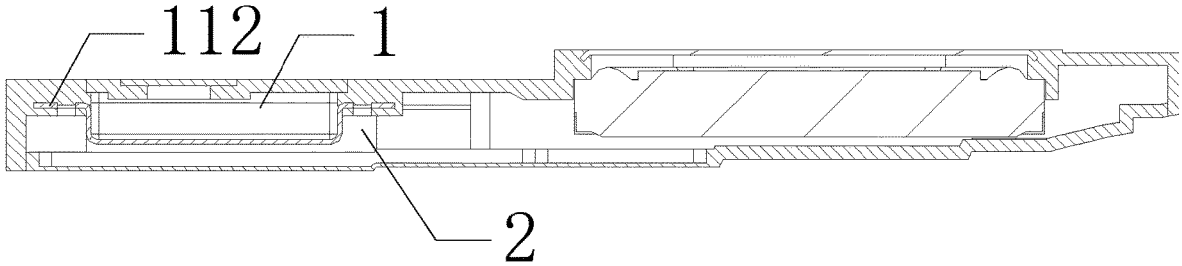
FIG. 4 is a sectional view of the loudspeaker module of the present disclosure.

FIG. 4 is a sectional view of the loudspeaker module of the present disclosure. The sound absorbing assembly 1 shown in the above embodiments is installed within the rear vocal cavity 2. As shown in FIG. 4, when the holding shell 11 is being fixed by injection molding, the fixing lugs 112 are injection molded within the housing of the vocal cavity of the loudspeaker module to achieve the fixing. A gap is provided between the bottom of the holding shell 11 and the bottom of the rear vocal cavity 2 of the loudspeaker module, and a width of the gap is 0.8 mm. The gap can ensure the forming of sound channels, to smoothly transmit sound to the sound absorbing material 12 of the sound absorbing assembly 1, to obtain a better acoustic quality effect by the sound absorption function.

Figure 5:
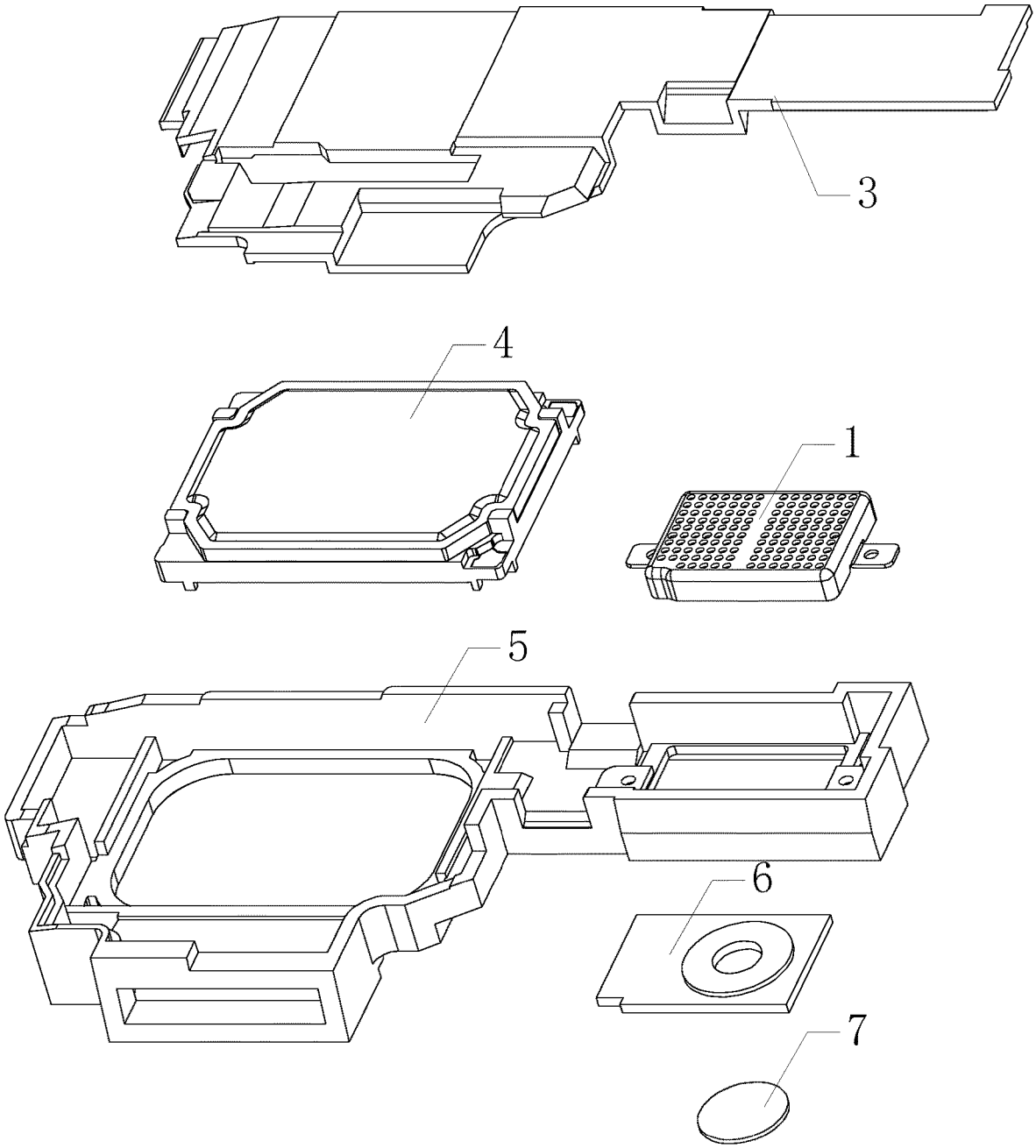
FIG. 5 is a exploded view of the loudspeaker module of the present disclosure.

FIG. 5 is a exploded view of the loudspeaker module of the present disclosure. As shown in FIG. 5, the loudspeaker module comprises a sealed lower housing 3, a loudspeaker unit 4, the sound absorbing assembly 1, the sealed upper housing 5, a medium housing 6 and a PET (polyethylene terephthalate) plate 7, which are assembled sequentially from top to bottom to form the loudspeaker module of the present disclosure.

In conclusion, the sound absorbing assembly of the present disclosure is provided with a receiving trough on the holding shell, and the sound penetration holes of the receiving trough form sound transmission channels, to enable the sound absorbing material placed within the receiving trough to perform the sound absorbing function, to improve the acoustic quality of the loudspeaker. In a preferable embodiment, the holding shell employs a stamping part, and has a thin wall thickness and a high strength, which can save the space of the vocal cavity, and facilitates improving the acoustic quality of the product. Furthermore, the holding shell is integral and is fixed within the rear vocal cavity of the loudspeaker module by injection molding, and compared with injection molding net cloth on a small cavity, the injection molding of the holding shell has a high yield, and has low requirements on the injection molding process, which can save the cost and facilitates mass production.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A sound absorbing assembly for a loudspeaker module, wherein the sound absorbing assembly comprises a holding shell, the holding shell is provided with a receiving trough, the receiving trough is filled with a sound absorbing material, the holding shell is fixed within a rear vocal cavity of the loudspeaker module by injection molding, a bottom of the receiving trough is provided with sound penetration holes, and an interior of the receiving trough communicates with the rear vocal cavity via the sound penetration holes; and wherein two opposing edges of the holding shell are respectively provided with a fixing lug, the fixing lugs are provided with a positioning hole, and when the holding shell is being fixed by injection molding, the fixing lugs are injection molded within a housing of a vocal cavity of the loudspeaker module.

2. The sound absorbing assembly according to claim 1, wherein the holding shell is a metal stamping part.

3. The sound absorbing assembly according to claim 2, wherein a material of the metal stamping part is stainless steel or copper alloy, and a plate thickness of the metal stamping part is 0.15 mm.

4. The sound absorbing assembly according to claim 1, wherein a depth of the receiving trough is 1.5 mm.

5. The sound absorbing assembly according to claim 1, wherein a trough wall of the holding shell is also provided with sound penetration holes.

6. The sound absorbing assembly according to claim 1, wherein the sound penetration hole is of a circle shape, with a diameter of 0.1 mm, and a plurality of the sound penetration holes are evenly distributed.

7. The sound absorbing assembly according to claim 1, wherein the sound absorbing material is non-foaming porous particles.

8. A loudspeaker module, wherein the sound absorbing assembly according to claim 1 is installed within a rear vocal cavity of the loudspeaker module.

9. The loudspeaker module according to claim 8, wherein a gap is between a bottom of the holding shell and a bottom of the rear vocal cavity, and a width of the gap is 0.8 mm.

* * * * *